US009841234B2

(12) United States Patent
Stahl

(10) Patent No.: US 9,841,234 B2
(45) Date of Patent: Dec. 12, 2017

(54) DRYING DEVICE

(71) Applicant: Cefla Deutschland GmbH, Meckenheim (DE)

(72) Inventor: Gerhard Stahl, Bad Neuenahr-Ahrweiler (DE)

(73) Assignee: Cefla Deutschland GmbH, Meckenheim (DE)

( * ) Notice: Subject to any disclaimer, the term of this patent is extended or adjusted under 35 U.S.C. 154(b) by 0 days.

(21) Appl. No.: 15/079,334

(22) Filed: Mar. 24, 2016

(65) Prior Publication Data

US 2016/0282047 A1 Sep. 29, 2016

(30) Foreign Application Priority Data

Mar. 24, 2015 (DE) ..... 10 2015 205 338

(51) Int. Cl.

| | |
|---|---|
| ***F26B 21/12*** | (2006.01) |
| ***F26B 3/28*** | (2006.01) |
| ***F26B 15/12*** | (2006.01) |
| ***F26B 3/04*** | (2006.01) |
| ***F26B 3/30*** | (2006.01) |
| ***F26B 15/00*** | (2006.01) |

(52) U.S. Cl.

CPC ..... *F26B 21/12* (2013.01); *F26B 3/04* (2013.01); *F26B 3/283* (2013.01); *F26B 3/30* (2013.01); *F26B 15/00* (2013.01); *F26B 15/12* (2013.01)

(58) Field of Classification Search

CPC .. F26B 21/12; F26B 3/04; F26B 3/283; F26B 3/30; F26B 15/00; F26B 15/12

USPC ..... 34/569

See application file for complete search history.

(56) References Cited

U.S. PATENT DOCUMENTS

| | | | | |
|---|---|---|---|---|
| 2,049,711 | A * | 8/1936 | Lundy | F26B 15/12 118/58 |
| 4,535,548 | A * | 8/1985 | Hyde | B41M 5/42 118/642 |
| 5,447,566 | A * | 9/1995 | Loiacono | B05C 1/083 101/220 |
| 5,623,770 | A | 4/1997 | Hoffmann | |
| 5,888,592 | A | 3/1999 | Biallas et al. | |
| 5,974,687 | A * | 11/1999 | Gante | F26B 3/347 34/265 |
| 6,481,117 | B2 * | 11/2002 | Turatti | F26B 5/12 34/164 |
| 6,794,127 | B1 * | 9/2004 | Lafferty | B01J 19/0046 435/183 |
| 6,858,261 | B1 | 2/2005 | Bär et al. | |

(Continued)

FOREIGN PATENT DOCUMENTS

| | | | |
|---|---|---|---|
| DE | 3817972 | A1 | 11/1989 |
| DE | 19628831 | A1 | 1/1998 |

(Continued)

*Primary Examiner* — Stephen M Gravini
(74) *Attorney, Agent, or Firm* — The Webb Law Firm

(57) ABSTRACT

A drying device for drying coated, elongated work pieces in a continuous process including a transport device for transporting the work piece. For drying an edge or surface of the work piece, heat sources are arranged in a drying chamber. In a drying zone, drying vapor is generated during drying. The vapor is removed by an airflow. The airflow is supplied via a supply channel and fans. A controller is provided to control the fans.

20 Claims, 1 Drawing Sheet

(56) References Cited

U.S. PATENT DOCUMENTS

| | | | | |
|---|---|---|---|---|
| 7,694,432 | B2 * | 4/2010 | Eriksson | F26B 3/283 110/245 |
| 8,367,978 | B2 * | 2/2013 | Williams | F26B 3/283 219/388 |
| 8,875,414 | B2 * | 11/2014 | Blomquist | F26B 3/04 104/172.3 |
| 8,959,793 | B2 * | 2/2015 | Zea | F26B 3/04 165/104.21 |
| 8,997,374 | B2 * | 4/2015 | Sato | F26B 3/283 118/642 |
| 2008/0099459 | A1 | 5/2008 | Williams | |
| 2008/0104861 | A1 * | 5/2008 | Yahiro | F26B 13/10 34/463 |
| 2008/0184589 | A1 * | 8/2008 | Shivvers | F26B 3/08 34/504 |
| 2010/0199510 | A1 * | 8/2010 | Plavnik | F26B 3/283 34/60 |
| 2012/0094031 | A1 | 4/2012 | Schmitt et al. | |
| 2014/0208606 | A1 * | 7/2014 | Mathis, Jr. | F26B 3/0923 34/164 |
| 2015/0121720 | A1 * | 5/2015 | Wieland | F26B 15/14 34/493 |
| 2015/0226479 | A1 * | 8/2015 | Fujita | F26B 3/30 34/266 |
| 2016/0282047 | A1 * | 9/2016 | Stahl | F26B 3/283 |

FOREIGN PATENT DOCUMENTS

| | | | | |
|---|---|---|---|---|
| DE | 102009023115 | A1 | 11/2010 | |
| DE | 102012207312 | A1 * | 11/2013 | F26B 15/14 |
| DE | WO 2013164285 | A1 * | 11/2013 | F26B 15/14 |
| EP | 0656514 | A1 | 6/1995 | |
| EP | 1144129 | B1 | 4/2003 | |
| EP | 2253384 | A1 | 11/2010 | |
| EP | 2409778 | A1 | 1/2012 | |

* cited by examiner

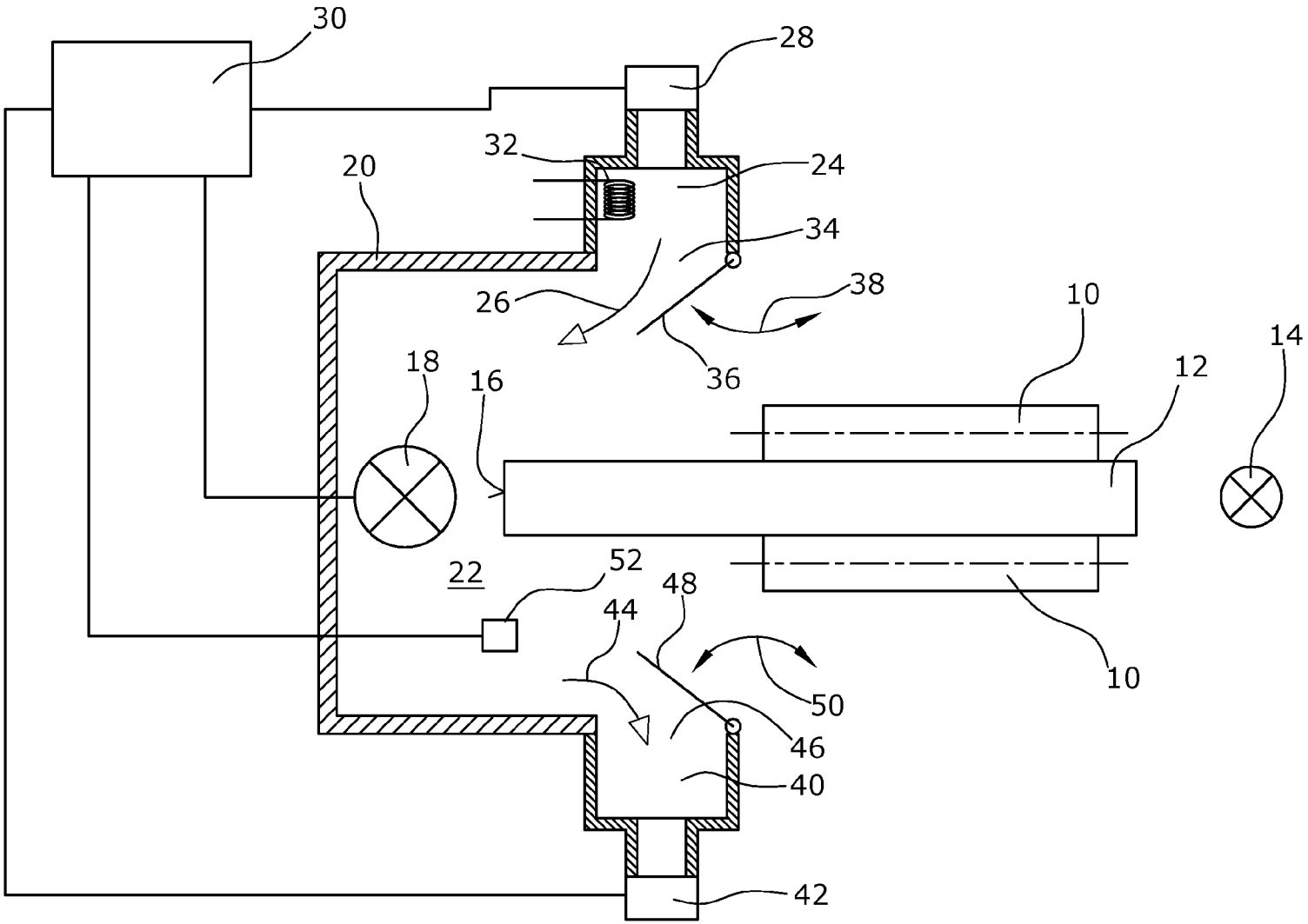
14
12
10
10
38
24
34
28
36
26
32
30
20
18
16
22
52
44
48
50
46
40
42

DRYING DEVICE

CROSS-REFERENCE TO RELATED APPLICATION

This application claims priority to German Patent Application No. 10 2015 205 338.5 filed Mar. 24, 2015, the disclosure of which is hereby incorporated in its entirety by reference.

BACKGROUND OF THE INVENTION

Field of the Invention

The present invention relates to a drying device for drying elongated work pieces, in particular work pieces being coated with paint, lacquer or the like, in a continuous process.

Description of Related Art

Elongated work pieces, in particular of wood or plastics, are coated at least in part, for example after profiling. Here, coating is performed in a continuous process in which the work piece is moved through a chamber, for example, in which for example all surfaces, only individual edges etc. are coated in particular with paint, lacquer or the like. Such a device for coating elongated work pieces in a continuous process is described for example in European Application Nos. EP 10 162 699 and EP 11 174 355.

Drying has to be performed immediately after coating, in particular after coating an edge of an elongated workpiece. For this purpose it is known to provide a drying device directly after the coating device. The work piece is also transported through the drying device in a continuous process. It is known to carry out the drying by means of heat sources such as infrared lamps. This is described for example in European Patent No. EP 1 144 129.

It is a problem of such drying devices that for example a layer of paint or lacquer does not dry thoroughly, but that a dry, dense skin, a so-called film, is formed at the surface and wet paint or lacquer remains thereunder. This may for example lead to blistering during the further drying process. If the product is packaged in film materials, for example, the residual water from the lacquer is later visible as water drops in the packaged product. Further, it is demanded that the passage times are short in order to keep the production costs, in particular the power consumption, low. The formation of a film is particularly critical with film-forming lacquers, in particular with such lacquers having a high proportion of solid particles.

Specifically, it is demanded that the drying should remove more than 90%, preferably more than 92% of the water in the coating material. Packing the elongated work pieces, in particular glass/rock wool boards, is possible only with the proportion of water appropriately reduced, since otherwise condensate may be formed.

SUMMARY OF THE INVENTION

It is an object of the present invention to provide a drying device for drying coated, elongated work pieces in a continuous process, by which it is possible to achieve a thorough drying of the coating in short passage times.

The present invention drying device for drying for example elongated work pieces, in particular work pieces being coated with paint, lacquer or the like, in a continuous process comprises a transport device for an in particular continuous transport of the work piece. In particular the elongated work pieces are glass/rock wool boards and wood fibre boards. The work pieces substantially have a rectangular cross section, with individual edges and surfaces possibly being profiled. Since, in a particularly preferred arrangement, the drying device is directly connected with a coating device, it is even possible, for example, to use the same transport device to first move the elongated work pieces through the coating device and then directly through the drying device. The transport device preferably has a plurality of belts or rollers on which the elongated work piece lies for transport. Possibly, opposite belts and/or rollers are provided, between which the work piece is arranged for transport.

For drying, in particular for drying an edge of a coated work piece, a heat source is provided to generate drying heat in a drying zone. The heat source preferably comprises at least one, in particular a plurality of infrared lamps. The at least one infrared lamp is preferably arranged in parallel with the work piece edge to be dried. Studies have shown that sometimes a thorough drying is not achieved in short dwell times, since a vapor dome forms in the drying zone due to the vapor produced as the coating is dried, so that, for example, the work piece edge to be dried is surrounded by the vapor dome in the drying zone. As a result the further drying is adversely affected.

According to the invention an airflow generating means, such as a fan, is provided to at least partly remove this drying vapor in the drying zone by means of an airflow. Here, the airflow may be generated by suction and/or blowing. It has further been found that this airflow possibly causes an undesired cooling in the drying zone. The reduction in temperature may adversely affect the drying so that longer dwell times would be required that would drastically increase the production time and costs. Therefore, the invention additionally provides a control means for controlling the quantity of air supplied to or discharged from the drying zone by the airflow generating means. It is thereby possible to remove an exact quantity of vapor from the drying zone, while keeping the temperature decrease in the drying zone low, so that a thorough drying in particular of an edge of an elongated work piece can be achieved in a continuous process with acceptable short dwell times. In addition to a regulation or control of the quantity of air supplied to and/or discharged from the drying zone, it is possible to regulate or control the heat source using the control means.

It is further preferred to use the control means to additionally adjust the airflow in dependence on the feed rate of the work piece to be dried.

Preferably, the control means is used to control the rotational speed of one or a plurality of fans of the airflow generating means in order to supply air to the drying zone and/or to discharge or draw air from the drying zone. In particular, a module, such as a frequency converter, is provided for this purpose.

Preferably, the airflow generating means comprises a supply channel and/or a discharge channel for supplying or discharging air or vapor to or from the drying zone. The supply and/or discharge channel preferably extends in the longitudinal direction of the work piece or in the transport direction of the work piece. In particular, the supply and/or the discharge channel is arranged in parallel with the work piece edge to be dried. In particular, the supply and/or discharge channel extends over the entire length of the drying device.

In addition to or instead of the rotational speed control of one or a plurality of fans, it is also possible to provide throttle means. Such throttle means may be arranged in an outlet opening of the supply channel, for example. The quantity of air supplied to the drying zone can be varied depending on the setting of the throttle means which, for example, comprises a plurality of throttle flaps, lamella-like slits or the like. A corresponding throttle means may also be provided in an inlet opening of a discharge channel. Depending on whether a supply channel may be provided at the throttle means and/or a discharge channel may be provided at the throttle means, the corresponding throttle means is connected with the control means to adjust the quantity of air supplied to and/or discharged from the drying zone.

In a preferred embodiment the drying zone is arranged in a drying chamber or is formed by the drying chamber. The drying chamber which preferably is substantially U-shaped in cross section, is configured such that the work piece portion to be dried, e.g. a work piece edge, protrudes into the drying chamber. Instead of a drying chamber that is open towards the work piece, is substantially U-shaped in cross section and extends in the transport direction, it is also possible to provide an elongated drying chamber that completely surrounds the work piece and has an inlet opening and an outlet opening.

In a particularly preferred embodiment the drying chamber is designed such that it has a slot-shaped opening extending in the longitudinal or transport direction of the work piece. A part of the work piece protrudes through the opening into the drying chamber. The elongated work piece is transported in the direction of the slot. It further preferred that the chamber wall that forms the slot-shaped opening comprises a thermal insulation board or is made of a thermal insulation board. This has the advantage that the great heat emitted from the heat source is kept away in particular from the transport device. Thereby, in a preferred embodiment, the transport device is shielded from the heat emitted by the heat source. In particular when infrared radiators radiating in the mid-infrared range (MIR range) are used as heat sources, such a shielding of the transport device is advantageous, since otherwise the transport device would be destroyed or at least be damaged. It is therefore particularly preferred that the opening has a height that is only slightly greater than the thickness of the work piece. Specifically, the height of the opening is less than 10 mm, in particular less than 6 mm and, particularly preferred, less than 4 mm larger than the thickness of the workpiece. Thus, substantially no heat gets from the drying chamber towards the transport device.

In a particularly preferred embodiment the transport device is arranged in particular entirely outside the drying chamber.

The heat source that preferably comprises a plurality of infrared lamps may be designed such that a plurality of infrared lamps or other heat sources surround the work piece. In a drying device for drying a work piece edge, the heat source is preferably arranged inside the drying chamber such that it is situated opposite the portion of the workpiece to be dried, e.g. the work piece edge, and that it preferably extends in parallel with the same or extend in the transport direction.

In another preferred embodiment a humidity sensor is provided in particular in the drying zone, which sensor is connected with the control means. One or a plurality of humidity sensors can measure the degree of humidity and are preferably provided in the at least one discharge channel. By measuring the humidity in the drying zone and in the discharged air, it is possible to control the quantity of air supplied to and/or discharged from the drying zone, in particular by controlling the rotational speeds of fans and/or by controlling throttle means. As an alternative or in addition, it is also possible to control the quantity of heat supplied by the heat sources.

In another embodiment a heating means is provided for heating the air supplied to the drying zone. Thereby, it is possible, despite the discharge of vapor from the drying zone, to reduce the temperature decrease in the drying zone caused by said discharge or to even avoid a decrease entirely.

With the drying device of the present invention it is possible in particular to fully dry layer thicknesses of 500 to 1000 μm or to achieve a thorough drying. This may be performed in a continuous process within 20 to 30 seconds. Here, the heat source generates a temperature of 30° C.-80° C. at the surface to be dried. In particular, the heat sources used are infrared lamps.

Preferably, medium wave IR radiators with a wavelength of in particular 3-50 μm are used as the lamps. These have a surface temperature of 850° C.-900° C. Therefore, it is preferred to arrange the radiators at a distance of 3 cm-4 cm from the region to be dried, so as to avoid in particular any damage to the surface.

Typically, the feed rate of the elongated work piece in the drying means is at least 20 m/min. However, feed rates of more than 50 m/min, in particular of more than 100 m/min are also conceivable, using the drying means of the present invention a reliable and also fast drying can be performed. This is advantageous in particular for economic reasons, since the energy consumption of the lamps per meter drying length is 6 kWh-12 kWh, possibly even up to 20 kWh.

In a particularly preferred development of the invention a humidification means is provided in the airflow supplied, in particular in the supply channel. Thereby, the air supplied to the drying zone can be humidified. Therefore, in this preferred embodiment, the air humidity prevailing in the drying zone can be adjusted very exactly so that an extremely high quality can be achieved. In particular, the humidification means is connected with the control means so that the humidification means can be controlled in particular as a function of the sensor-detected humidity prevailing in the drying zone. Thereby, the risk of blistering is drastically reduced in particular also for thick layers of in particular film-forming lacquers.

In particular, a coating device is arranged immediately downstream of the drying device. This may for example be a coating device as described in European Application Nos. EP 10 162 699 and EP 11 174 355.

BRIEF DESCRIPTION OF THE DRAWING

FIG. 1 shows a schematic sectional view of an embodiment of a drying device according to the invention.

DESCRIPTION OF THE INVENTION

For drying coated elongated work pieces in a continuous process, a drying device comprises a transport device schematically indicated in the embodiment illustrated by two transport rollers 10. An elongated work piece 12, such as a board for example, is arranged between the two transport rollers 10 and is transported by the transport rollers 10 perpendicularly to the drawing plane in the direction of an arrow 14. In the embodiment illustrated, for example an edge 16 of the workpiece 12 has been coated with lacquer, paint or the like in the coating device arranged upstream of the drying device. For drying, a heat source, in particular one or a plurality of infrared lamps 18, is provided. In the embodiment illustrated these are arranged in parallel with the coated edge or lateral surface 16 of the work piece 12. The heat source 18 is arranged in a housing 20 of the drying device. In the embodiment illustrated, the latter has a U-shaped cross section, with the surface 16 to be dried protruding into the housing 20.

Due to the drying heat, drying vapor is generated in a drying zone 22 by the drying of the lacquer or the paint. In this embodiment air is supplied to the drying zone 22 via a supply channel 24 in the direction of an arrow 26 in order to discharge the drying vapor. The supply channel, which also extends in the longitudinal direction or the transport direction 14, comprises one or a plurality of airflow generating means such as fans 28. For the purpose of controlling the quantity of air supplied to the drying zone 22, the at least one fan 28 is connected with a control means 30. Further, a heat source 32 may be provided in the supply channel 24 for pre-heating the air supplied, the heat source preferably also being controllable via the control means.

Further, a throttle means 36 may be provided in the region of an outlet opening 34 of the supply channel 24. In the embodiment illustrated the same is shown as a throttle flap pivotable in the direction of an arrow 36. By providing the throttle flap 36, it is not only possible to throttle the quantity of air supplied, but also to deflect the same. The position of the throttle flap may preferably also be controlled by means of the control means.

In the embodiment illustrated a discharge channel 40 is provided opposite the supply channel 40. The discharge channel 40 is structured in a manner similar to the supply channel 24 and also comprises an airflow generating means with, for example, a plurality of fans 42 to draw air from the drying zone 22 in the direction of an arrow 44. The plurality of fans 42 are also connected with the control means 30 to be controlled thereby.

Further, a throttle means 48, such as a throttle flap, may also be provided in the region of an inlet opening 46 of the discharge channel 40, the throttle flap being pivotable in the direction of an arrow 50. The position of the throttle flap 40 may also be controlled by means of the control means 30.

It is further preferred to provide a humidity sensor 52 in the drying zone 22. Again, the same is connected with the control means 30.

Further, in a particularly preferred embodiment, an air humidification means 54 is provided in the supply channel 24. The former is preferably connected with the control means 30. Thereby, it can be prevented that the upper layer of a lacquer dries too fast. Film formation is thus avoided, so that the water from the lacquer is dried as the lacquer layer is dried.

A chamber wall 56 directed towards the transport device 10 that in particular comprises a plurality of belts and rollers, is preferably made of a thermal insulation plate. Thereby, it is ensured that the heat radiation emitted by the heat source 18, which is in particular designed as an IR lamp, does not or only to a small extent heat the transport device 10. This avoids damage to the transport device 10. The two chamber walls or thermal insulation plates 56 also extend in the longitudinal direction 14 and serve as a screen. The two chamber walls 56 form an opening 58. The opening 58 has a height H that corresponds to the distance between the two chamber walls 56. The height H is slightly larger than the thickness d of the elongated workpiece d. Thus, only a small gap is formed between the opening 58 and the work piece 12.

In another preferred development of the invention a plurality of drying means is arranged one behind the other, in particular drying means corresponding to the above described different embodiments and, as is particularly preferred, corresponding to the embodiment illustrated in FIG. 1. It is possible for each drying means to adjust or control the individual parameters differently by means of a corresponding control means. In this regard it is of course possible to provide a common control device for the individual drying devices, so as to adjust them to each other.

The invention claimed is:

1. A drying device for drying coated, elongated workpieces in a continuous process, comprising:

a transport device for a continuous transport of a workpiece, a heat source for generating drying heat in a drying zone, an airflow generator for removing drying vapor from or supplying humidity to the drying zone via an airflow, a controller for controlling a quantity of air supplied to or discharged from the drying zone by the airflow generator, and a humidity sensor connected with the controller.

2. The drying device of claim 1, wherein the drying zone is arranged in a drying chamber and a part of the workpiece that is to be dried protrudes into the drying chamber.

3. The drying device of claim 2, wherein the drying chamber is substantially U-shaped in cross section.

4. The drying device of claim 2, wherein the drying chamber has a slot-like opening extending in a transport direction and the part of the workpiece that is to be dried protrudes through the slot-like opening.

5. The drying device of claim 4, wherein a chamber wall comprising the slot-shaped opening comprises thermal insulation plates.

6. The drying device of claim 4, wherein the slot-shaped opening has a height that is slightly larger than a thickness of the workpiece, with the height being less than 10 mm larger than the thickness.

7. The drying device of claim 1, wherein the airflow generator comprises at least one fan connected with the controller for rotational speed control.

8. The drying device of claim 1, wherein the airflow generator comprises or is connected with a supply channel or a discharge channel for supplying or discharging air or drying vapor.

9. The drying device of claim 8, wherein a throttle for adjusting the quantity of air supplied to the drying zone is arranged in an outlet opening of the supply channel or a throttle for adjusting the quantity of air or vapor discharged from the drying zone is arranged in an inlet opening of the discharge channel.

10. The drying device of claim 9, wherein the throttle of the supply channel or the throttle of the discharge channel is connected with the controller to adjust the quantity of air or vapor supplied to or discharged from the drying zone.

11. The drying device of claim 2, wherein the heat source is arranged in the drying chamber.

12. The drying device of claim 1, wherein the heat source comprises an infrared lamp.

13. The drying device of claim 7, wherein a quantity of air supplied or discharged is controlled via the rotational speed of the fans or at least one throttle such that a complete drying of the coating is achieved.

14. The drying device of claim 1, wherein the humidity sensor is configured to measure humidity in the drying zone or the discharged air from the drying zone and communicate the measured humidity to the controller to control the air quantity supplied to or discharged from the drying zone.

15. The drying device of claim 1, further comprising an air humidifier.

16. The drying device of claim 2, wherein the transport device is arranged entirely outside the drying chamber.

17. The drying device of claim 11, wherein the heat source is arranged opposite a part of the workpiece that is to be dried or extends in a transport direction of the workpiece.

18. The drying device of claim 14, wherein the humidity sensor is provided in the drying zone.

19. The drying device of claim 15, wherein the air humidifier is provided in a supply channel for supplying air or drying vapor.

20. The drying device of claim 15, wherein the air humidifier is connected with the controller.

* * * * *